United States Patent [19]

Babbs

[11] 4,234,035

[45] Nov. 18, 1980

[54] TRIM LOCK

[75] Inventor: Frederick W. Babbs, Nottingham, England

[73] Assignee: Cox of Watford Limited, Nottingham, England

[21] Appl. No.: 694,706

[22] Filed: Jun. 10, 1976

Related U.S. Application Data

[63] Continuation of Ser. No. 562,944, Mar. 28, 1975, abandoned.

[30] Foreign Application Priority Data

Mar. 28, 1974 [GB] United Kingdom ..... 13835/74

[51] Int. Cl.[2] ..... A47H 13/00

[52] U.S. Cl. ..... 160/392; 160/395; 160/403

[58] Field of Search ..... 160/327, 392, 395, 394, 160/397, 403

[56] References Cited

U.S. PATENT DOCUMENTS

| | | | |
|---|---|---|---|
| 2,496,910 | 2/1950 | Fridolph | 160/327 X |
| 2,877,877 | 3/1959 | Davis, Jr. | 160/392 X |
| 3,090,646 | 5/1963 | Johnson | 160/392 X |
| 3,143,165 | 8/1964 | Lewis et al. | 160/395 X |
| 3,987,835 | 10/1976 | Bloomfield | 160/392 |

*Primary Examiner*—Kenneth Downey
*Attorney, Agent, or Firm*—Watson, Cole, Grindle & Watson

[57] ABSTRACT

This invention is a trim lock for holding trim in relation to a frame member of upholstered furniture by wedging the edge of the trim in a slot in the frame with a flexible trim strip which prevents the trim from being pulled from the slot but can itself be pulled out to allow the trim to be released.

8 Claims, 8 Drawing Figures

TRIM LOCK

This is a continuation of application Ser. No. 562,944 filed Mar. 28, 1975 now abandoned.

This invention relates to trim locking, that is to say, the securing of the edges of fabric or sheet plastics material covering upholstery on a seat frame, for example, in a motor vehicle or furniture. The fabric or other sheet material—known as the trim—may be fitted over loose padding, or padding secured to the seat frame, or the padding may be secured to the inside surface of the trim so that the trim and padding constitute a separable article for application to the frame.

According to the invention an upholstered article has a hollow section frame, means defining a slot in a face of the frame leading to the hollow, and trim retained in relation to the frame by having its edge in the hollow, being held gripped in the slot by an external strip with a part extending into the slot, and having a cross-section with an external flange for covering the outer face of the trim, a neck extending into the slot and a head carried on, and wider than, the neck and positioned on the inside of the slot.

The strip can be easily forced into the recess, possibly by use of a simple roller tool, and gives a very pleasant external appearance. It can also be pulled out again if the trim is to be replaced.

The trim edge does not have to be cut very accurately as long as it can be accommodated in the hollow interior of the frame. Also it can be compressed between the short edge and the strip so that trim with a wide range of trim thickness can be gripped or locked with the same size of slot and strip section.

The head of the strip section should be about as wide as, or wider than, the slot, so that if the trim is pulled the head will also be pulled and wedge the trim firmly against the slot edge.

The components can be made cheaply and the trim locked easily by unskilled labour.

The invention includes an elongate trim strip—possibly an extruded section of plastics material—having a pair of wings joined by a web such that when the web is bent double, the wings come together to define a single surface.

If the wings project from one side of the section in the manner of edge flanges, then at the centre of the web at the other side, there may be a pair of spaced protruberances which act to define a track for the roller tool and also act as stops at the apex of the fold when the web is bent double to give the folded strip a dovetail section. The wings can be deformed to accord with the shape of the trim section around the frame. The bend creates a bulbous form within the section to hold the strip and trim in place.

The invention may be carried into practice in various ways and certain embodiments will now be described by way of example with reference to the accompanying drawings, of which:

Figure 1:
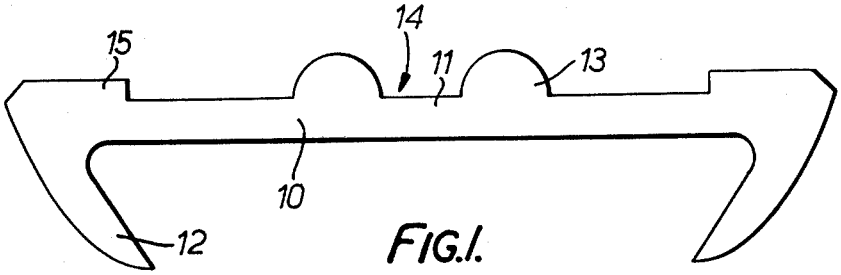
FIG. 1 shows the section of an undeformed trims trip.
Figure 2:
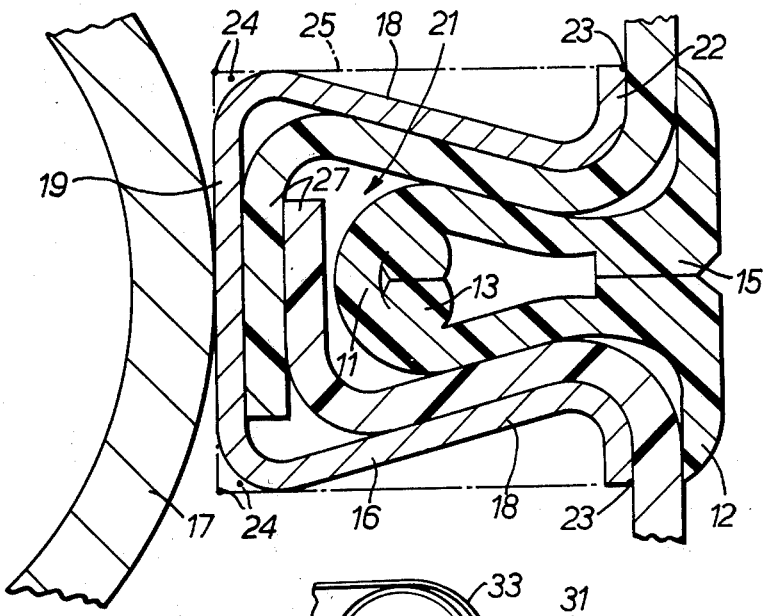
FIG. 2 shows the same strip deformed to hold trim edges in a trim section around a seat frame.
Figure 5:
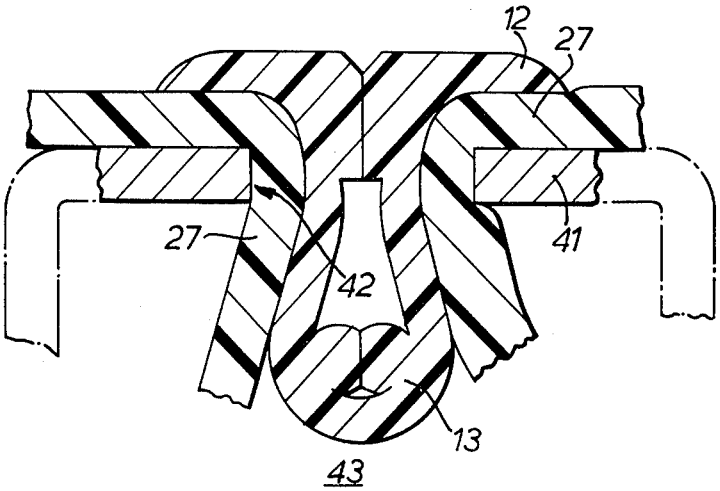
FIG. 5 is a section showing the trim strip of FIG. 1 in use holding fabrics in relation to a box section frame member.

The trim strip in FIGS. 1, 2 and 5 is an elongate extruded polyethylene, or other plastics moulding 10 with the section shown in FIG. 1 having a central web 11 and a pair of wings 12 protruding one from each edge of the web at one side at an angle of about 45°. On the opposite side of the web are a pair of ribs 13 spaced apart to define a gap or track 14. There are also shoulders 15 at each edge opposite the wings.

The trim section 16 is welded around the seat frame 17 as shown in FIG. 2 and consists of two sides 18 and a base 19 defining a dovetail recess 21, and a pair of flanges 22 on either side of the mouth of the recess which define corners 23 of the section. Those two corners, together with the corners 24 where the base joins the sides 18 lie at the corners of a square 25. A U-shaped forming block can deform such a section about either of the principle axes in the plane of FIG. 2 so that the trim section can be shaped to suit the form of the seat frame 17.

The edges of the trim 27 are held over the mouth of the recess and then the strip is pushed into the recess by use of a rolling tool running along the track 14 until the web is bent double with the ribs 13 abutting each other and the shoulders 15 abutting each other, and the wings conforming to the shape of the flange 22 at the mouth of the trim section.

It can be seen that the section and strip define a dovetail-section gap into which the trim edges are forced and held securely. However the trim edges can be released after removing the strip by pulling on the wings 12.

Figure 3:
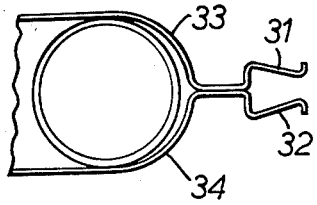
FIGS. 3 and 4 show two ways of building up the trim section.
Figure 4:
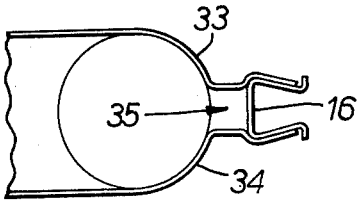

FIG. 3 shows how the section need not be separately formed and welded to the frame but can consist of two part sections 31 and 32 each formed integrally with one of a pair of pressings 33 and 34 which are welded together to form the frame. FIG. 4 shows how two pressings 33 and 34 can be held in close relationship to define a slot 35 for the section shown in FIG. 2.

If desired the trim edges 27 can be vacuum formed into an undercut or L-section for fitting into the trim section, and also such pre-formed edges can be held in position by spring clips before the trim strip is rolled in. In general however, this is unnecessary, and rough cut edges of any width can be secured.

FIG. 5 shows the strip of FIG. 1 used in relation to a trim section having a rather sharp-edged slot 42 which is 5 mm. wide, which is the same as the narrowest part of the curved entry to the dovetail in the section 16 of FIG. 2. The slot 42 may be in a wall 41 which is part of an attachment welded to the frame 17 of FIG. 2, or could indeed be a part of the frame member 17 itself. As long as the wall 41 defines a box 43 large enough to accommodate the free edges of the trim, its size can in other respects be determined by the necessary strength for it to act as a structural member of the seat. Gripping of the trim edges is merely by co-operation between the slot 42 and the trim section 12.

Thus the two trim edges 27 are pushed into the slot and the trim strip is then forced in. It holds the trim edges firmly against the edges of the slot 42 which have square corners. Any tendency to pull the trim from the slot tends to pull out the strip 12 also, and its bulbous part 13 tends to wedge the trim harder against the slot edges. However, if the trim is to be replaced, the strip 12 is first pulled out by use of the wings, peeling the strip back from one end. Then the edges 27 are free.

It may be seen that the thickness of the trim is not critical as it can be compressed, and if compressed gives a better grip, and also the size of the section 41 is not critical provided the section has a neck a little smaller than the slot 42. In fact the bulbous part 13 can just pass through the slot without interference if there is no trim present.

If the trim is thick enough it is possible to hold a single trim edge wedged between the edge of the slot and the trim strip, the strip resting against the opposite edge of the slot.

Figure 6:
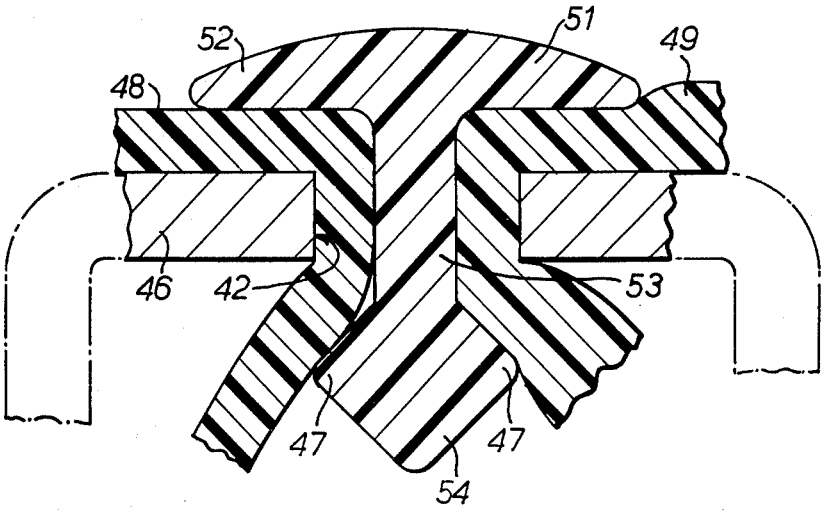
FIGS. 6 and 7 are sections similar to FIG. 5 with different forms of trim section.

The trim section 46 shown in FIG. 6 is of substantially square section with the slot 42 in one face for say, fabric 48 and the edge 49 of a rigid plastics moulding forming a decorative cover for the mounting components below a seat. The trim strip 51 has a section with an external flange 52 for covering the slot 42 and the fabric edges, the neck 53 extending into the slot 42, and a square section head 54 at the inner end of the leg.

It has been found that the corners 47 on the head 54 tend to wedge the fabric 48 and 49 against the edges of the slot 42 if the fabric is pulled.

The section 46 is a main structural component of the seat frame, possibly extending all the way around the edge of the seat cushion and the seat back or squab.

Figure 7:
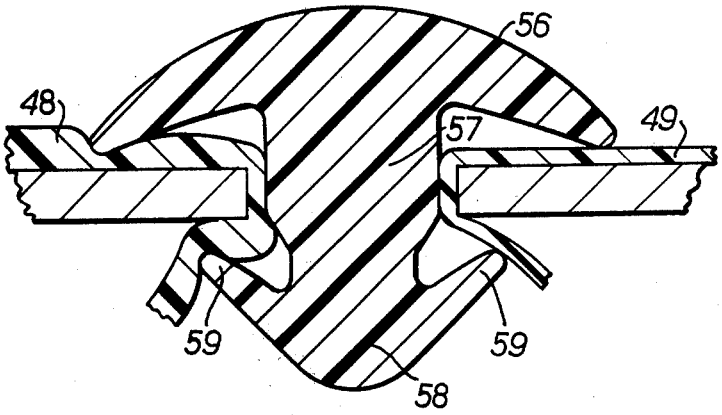

FIG. 7 shows an alternative trim strip section which could be used in place of the section 51 in FIG. 6. The external flange 56 is of convex/concave form, the neck 57 is thicker than in FIG. 6, and the head 58 has prongs 59 extending back towards the flange which fill the function of the corners 47 in FIG. 6.

The prongs 59 can deflect as the strip is pressed in, due to the resilient flexibility of the material from which it is made. Any of the trim strips can be forced, together with the fabric edge, into the slot by a tool with a rotary head pressed against the fabric outside the slot and running around the trim section. The trim strip can be drawn from a roll, and cut off when the complete circuit of the seat frame has been made.

The trim section of all figures is conveniently of rigid or semi-rigid plastics material.

Figure 8:
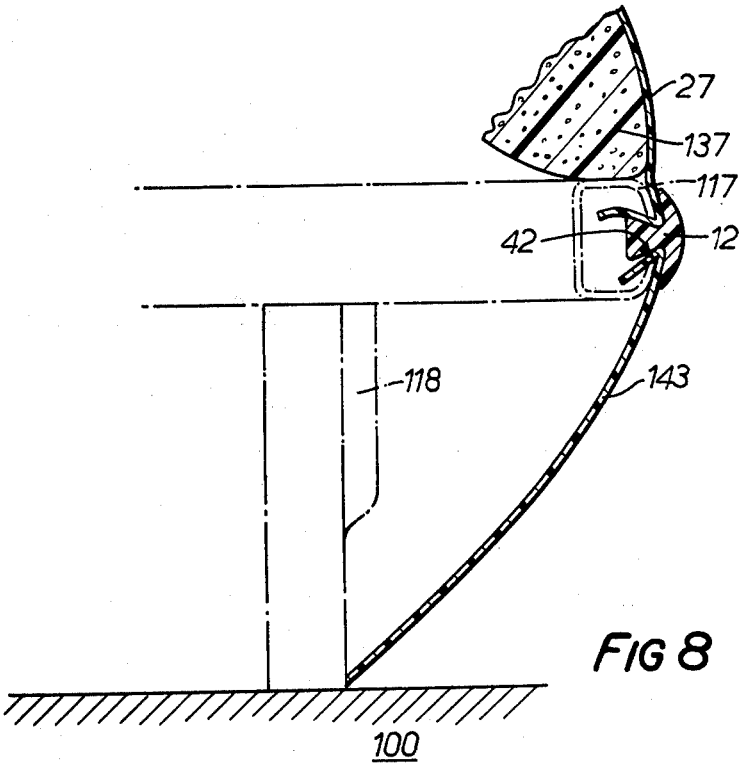
FIG. 8 is a section of one edge of a car seat showing the trim and strip in position.

In FIG. 8 a seat has a frame comprising a horizontal peripheral loop with a section shown at 117 supported from a floor 100 through a mounting 118. Foam upholstery 137 is held in relation to the frame by being bonded to trim 27 having a free edge held in the slot 42 by a trim section 12 which may be like any of those shown in FIGS. 5, 6 and 7.

A thin-walled simi-rigid plastics moulding 143 conceals the mounting 118 and is located also by having its upper edge secured in the slot 42 in the frame member.

What I claim as my invention and desire to secure by Letters Patent is:

1. An upholstered article comprising:

a frame defined by a structure frame member which extends around a part of the edge of the article and has a hollow section, said frame member having opposing walls having a single sharp edge at the inner side of each wall, said opposing walls defining a slot in the face of said frame member and leading to said hollow section;

trim retained in relation to said frame by having a free, flexible edge contained within said hollow section;

upholstery integral with the trim except at the edge of the trim and retained in relation to the frame by the trim; and a single external strip pressing said trim against said sharp edges of said inner sides of said wall so as to grip said trim within said slot, said strip having a part extending into said slot and having a cross-section with an external flange for covering the outer face of said trim at a location adjacent said slot, a neck extending into said slot and a head carried on said neck, said head being wider than said neck and positioned on the inside of said slot to define a clearance space between said head and said hollow section wider than the thickness of the trim, said edge of said trim being free in said clearance space beyond the edges of said slot where it is gripped.

2. An article as claimed in claim 1 in which the width of the head is substantially equal to the width of the slot.

3. An article as claimed in claim 1 in which the width of the head is greater than the width of the slot.

4. An article as claimed in claim 1 in which the strip has been bent double so that the fold defines the head and the external flange is provided by two outer edges of the undeformed strip section which have come together during bending.

5. An article as claimed in claim 4 in which the strip section has means defining a track for a tool for bending it and forcing the head through the slot.

6. An article as claimed in claim 1 in which two trim edges are held in the slot, each being gripped between the strip and a different one of the two sides of the slot.

7. An article as claimed in claim 1 in which the strip is elongate and of resiliently flexible material.

8. An article as claimed in claim 1 in which the strip can be pulled manually from the frame by the external flange.

* * * * *